US005785379A

United States Patent [19]

Pelletier

[11] Patent Number: 5,785,379

[45] Date of Patent: Jul. 28, 1998

[54] MODULAR INDIVIDUAL SEAT PICNIC TABLE

[76] Inventor: Mead Timothy Pelletier, 16 Railroad Ave., Pearle River, N.Y. 10965

[21] Appl. No.: 695,066

[22] Filed: Jul. 31, 1996

[51] Int. Cl.[6] ..... A47B 39/00

[52] U.S. Cl. ..... 297/158.5; 297/440.14

[58] Field of Search ..... 297/440.14, 423.11, 297/157.1, 158.3, 158.5, 440.1, 440.22, 170, 171, 172; 108/50, 56.1, 180, 153

[56] References Cited

U.S. PATENT DOCUMENTS

| | | | |
|---|---|---|---|
| 2,746,525 | 5/1956 | Cooper | 297/158.5 |
| 2,800,952 | 7/1957 | McPhilomy | 297/158.5 |
| 2,964,368 | 12/1960 | Heyer | 297/158.5 X |
| 4,522,443 | 6/1985 | Van Blankenburg | 297/158.3 |
| 4,526,422 | 7/1985 | Mengshoel et al. | 297/157.1 X |
| 5,240,307 | 8/1993 | Jones et al. | 297/158.5 |

*Primary Examiner*—Milton Nelson, Jr.
*Attorney, Agent, or Firm*—Notaro & Michalos P.C.

[57] ABSTRACT

A modular picnic table with attached individual seats facing each other on opposite ends of a single multimembered frame part, constructed of either tubular aluminum, metal or tubular reinforced plastic. A plurality of multimembered frame parts connected in series by bolts and nuts and connector frame part to provide an unlimited modular seating frame system. A flat surface seat with support post part, interchanges with an angled ergo seat and knee rest support post part to connect to multimembered frame part in an existing frame form. End seating to table is provided by a distinctive modular part in modified shape of multimembered frame part. The multimembered end seat part attaches as optional individual seat and frame support.

1 Claim, 5 Drawing Sheets

FIG. 7
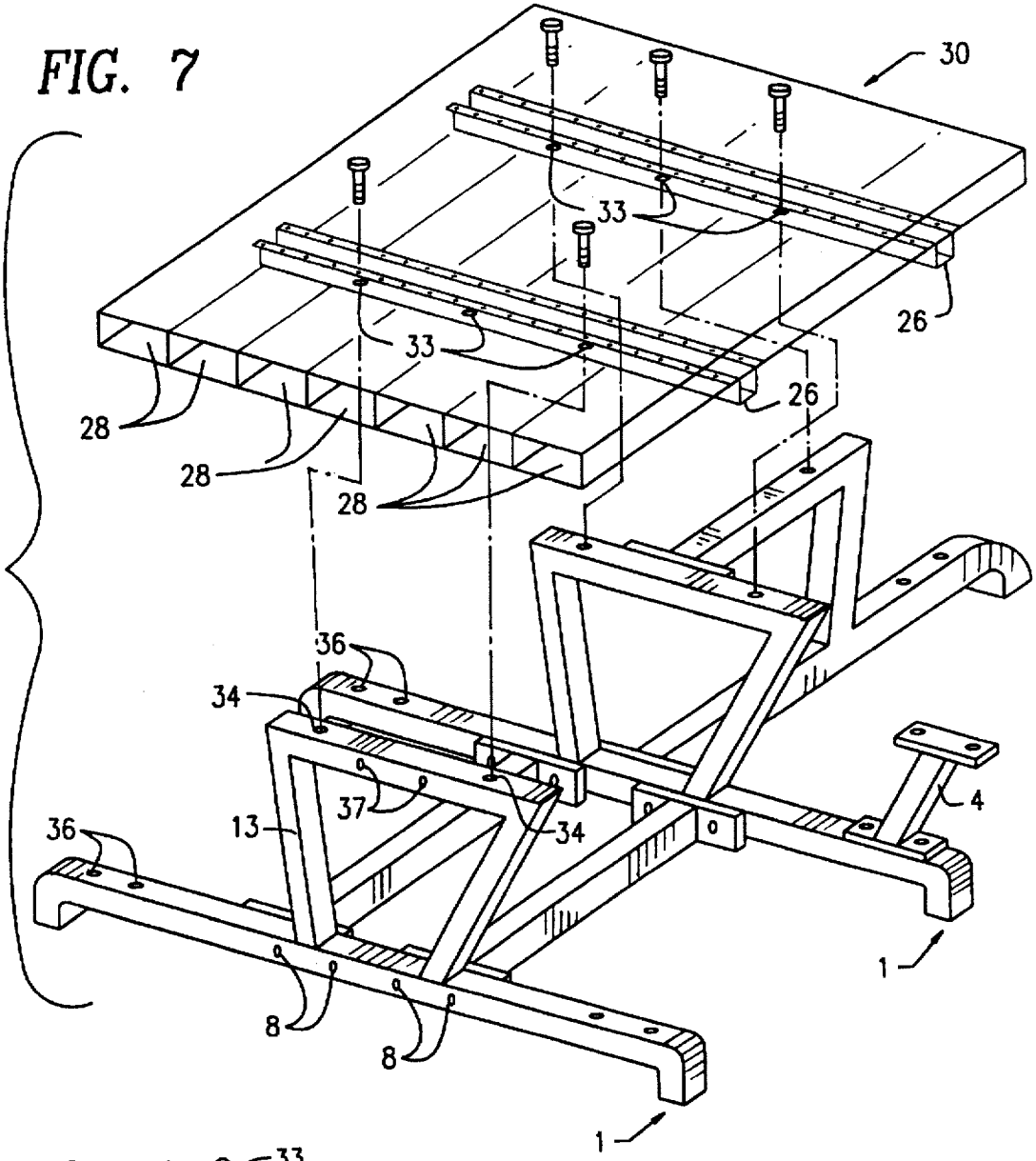
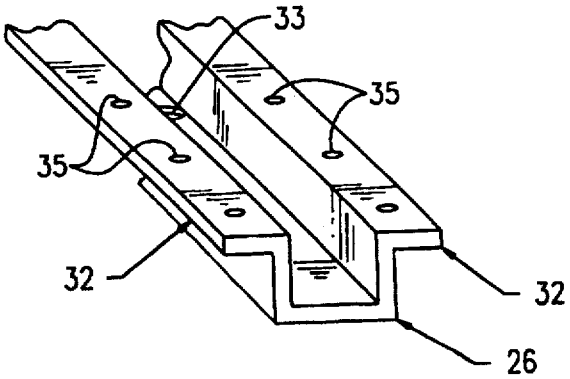
FIG. 8

MODULAR INDIVIDUAL SEAT PICNIC TABLE

BACKGROUND OF THE INVENTION

1. Field of the Invention

The present Invention relates to an outdoor picnic table, more specifically a picnic table with an expandable modular frame with attached individual seats.

2. Prior Art

Restrictive uncomfortable seating is a common experience for most people when using a conventional picnic table. Heavy weight and lack of adaptability usually limits its use to the outside only. Also, conventional continuous bench style seating hinders access onto and off the seating platform. Tables with individual seats attached to a table frame exist, but do not offer an expanding modular frame where interchanging seating options are available. These options are a standard individual seat with variable height, or an angled ergo seat with knee rest seating assembly. In an angled ergo seat kneeling position a person distributes pressure from sitting between the posterior region and the knees of the body, thereby putting less stress on the spine and promoting a healthier sitting position. In this field of furniture other individual seat picnic tables exist, as well as the design for ergo seat knee rest chairs. However, there exists no application for a table and seat frame, with modular seat posts and a modular frame as in my intended invention. What does exist are the following inventions with related designs:

| | | | | |
|---|---|---|---|---|
| Des. | 283,378 | 4/86 | OPSIK | 106/366 |
| | 3,189,379 | 6/65 | POTTER | 297-157 |
| | 4,060,275 | 10/77 | HANSEN | 297-159 |
| | 3,266,840 | 8/66 | d'ESTRUBE | 297-157 |
| | 3,542,420 | 11/70 | PRIEWE | 297-157 |
| | 3,261,640 | 7/66 | STRAITS | 297-135 |
| | 2,746,525 | 5/56 | COOPER | 297-158.5 |
| | 2,800,952 | 7/57 | McPHILOMY | 297-158.5 |
| | 2,964,368 | 12/60 | HEYER | 297-158.5XR |
| | 5,240,307 | 8/93 | JONES | 297-158.5 |
| | 4,522,443 | 6/85 | VAN BLANKENBURG | 297-158.3 |
| | 4,526,422 | 7/85 | MENGSHOEL | 297-157.1XR |

SUMMARY OF THE INVENTION

The principal object of the present invention is to provide a picnic table with attached individual seats on an expandable tubular aluminum, plastic, or metal frame.

It is also an object of the present invention to provide simple modular seating with inexpensive flat parts for ease of shipping and erecting into frame form.

Another object is to provide a frame that is interchangeable to form different configurations.

A further object is to provide a modular plastic table with a top surface in six foot, and four foot increments so as to provide an unlimited choice in the number of seats desired on a continuously attached frame.

The final objective is to provide an angled ergo seat with knee rest seating assembly, that can attach to existing frame.

The foregoing objects can be accomplished by providing a table frame system composed of a distinctive multimembered tubular component.

In the preferred embodiment of the invention, this principal frame component can be fabricated out of square tubular aluminum extrusions. As an option for this design, round, oval or rectilinear extrusions could be substituted for the manufacture of each component. The preferred composition of the component is aluminum, which can be substituted with thin wall metal, or thick walled plastic extrusion with an internal webbing for structural integrity.

The principal frame component is formed by a plurality of connected tubular members fused into a linear pattern that includes table leg supports, seat leg supports and upper and lower horizontal support cross members inclusively. The present invention comprises of a table having at least two principal frame components rigidly connected thereto by a horizontally positioned connector component. The connector components fix the position of the principal frame components adjacent to each other in series maintaining a frame work for table tops and table seats.

The bottom horizontal member of the principal frame component is provided with fastener holes on the vertical and horizontal surfaces. The holes on the vertical surface of horizontal member correspond to the holes on the connector component fastener plates. Also the holes on the horizontal surfaces of the said horizontal member, correspond to holes on fastener plate of seat post components. The table leg support member of the principal frame component are fused at an angle of 10 degrees. This angle allows for greater mobility between table leg and seat post.

An end seat frame component. The said component attaches to the side of the principal frame component, to provide an optional end seat perpendicular to principal frame component series. The end seat frame component is formed from a plurality of connected tubular members fused into a linear pattern that includes a singular table leg support member, a seat leg support member, and upper and lower horizontal cross members. The end seat frame pattern is of similar configuration to the principal frame component. The upper and lower horizontal members of the end seat component have fastener plates fused perpendicularly to linear arrangement of members. These said fastener plates provide a means for connecting the end seat component to the principal frame component.

A seat post component and an angled ergo seat and knee rest seat assembly component. These said components fastened to the principal frame component, and end seat frame component. The holes of horizontal members corresponding to holes on the seat post fastener plates, providing seating to table frame.

The table top surface is joined to existing modular frame by means of an elongated predrilled unshaped member. Table top surface is fastened to said u-shaped member by means of small self fastening screws. Table top components connected to table frame by means of a mechanical bolt and nut assembly.

Height and leveling of the present invention is achieved by a premanufactured leveler leg insert, friction fastened to bottom hollow portion of principal frame component, and the—end seat frame component.

BRIEF DESCRIPTION OF DRAWINGS

FIG. 7 is a perspective phantom drawing of table top component, with fragmentary view of table frame.

FIG. 8 is a detailed perspective view of modified U-shaped table top connector member.

DETAILED DESCRIPTION

Figure 1:
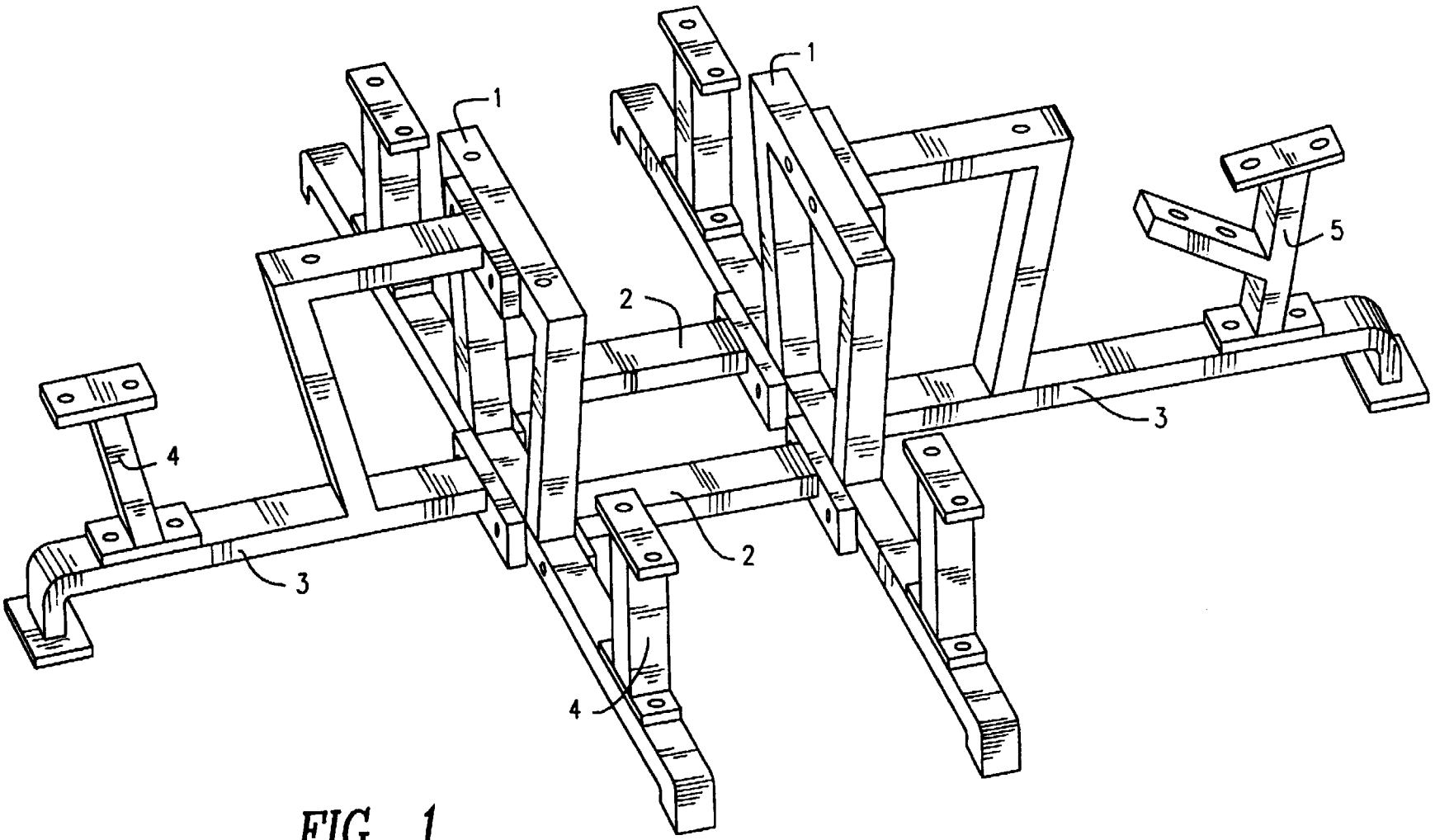
FIG. 1 is a numbered perspective drawing of table frame less table top component, seat component, and knee rest pad component. The frame configuration contains all components in the modular table frame set.

As shown in the drawings particularly FIG. 1 the table in accordance with present invention, includes a complete modular table frame set, comprising of five individual frame work components.

Figure 2:
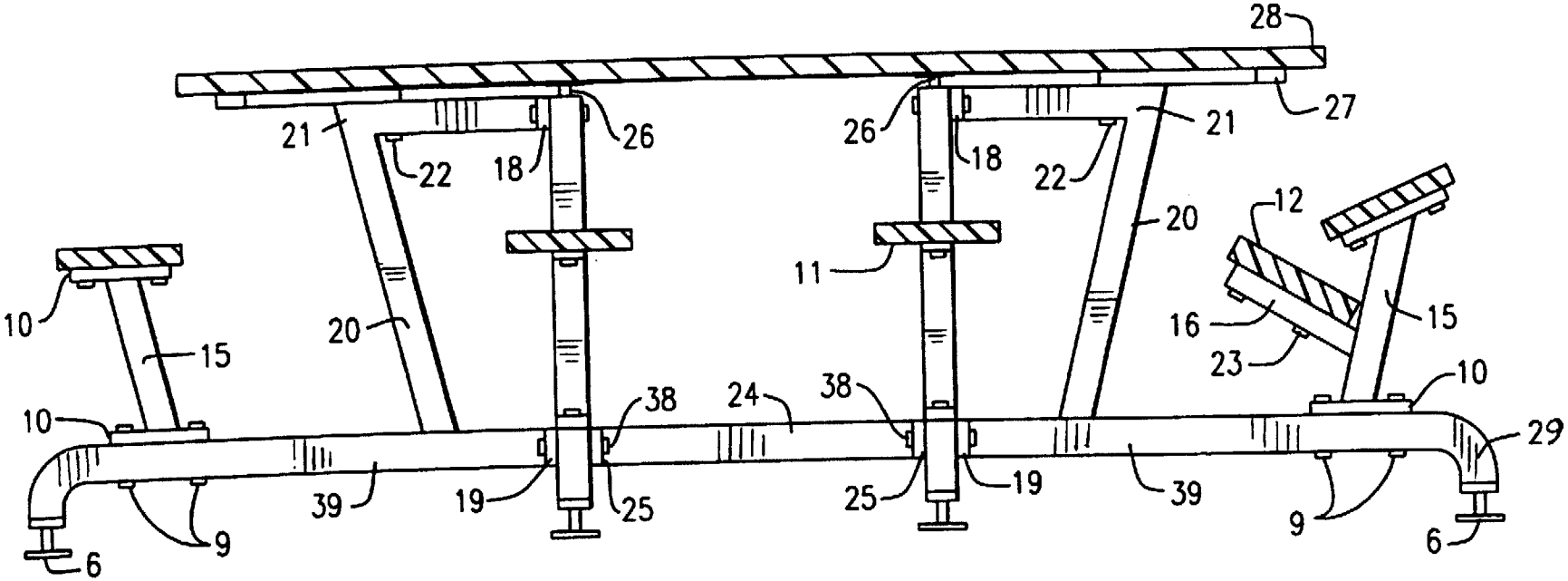
FIG. 2 is a side elevation view of table, with all component modular table frame set.
Figure 3:
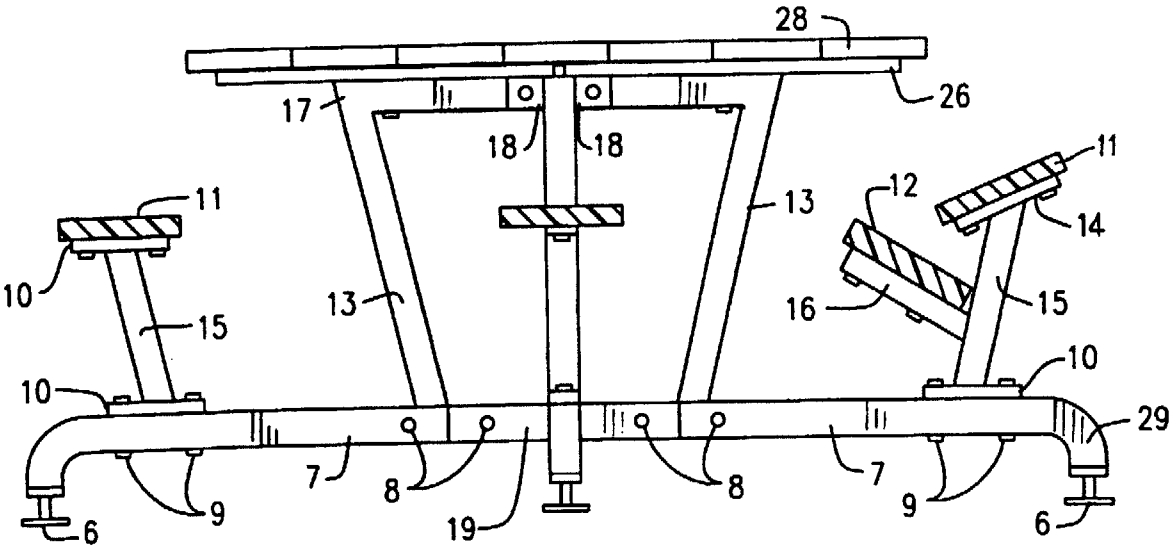
FIG. 3 is an end view of modular table frame set.

A table leg and seat leg component 1 as shown in FIG. 1 preferably of a square tubular structure. The said component having four fastening holes drilled midway 8 as in FIG. 7 on vertical surface of horizontal member 7 as shown in FIG. 2 for the purpose of joining connector component 2 to table leg and seat leg component 1. The said table leg and seat leg component is formed from four tubular members fused together in linear arrangement. The said members are predrilled 8, 36, 34 as in FIG. 7 for fastening means to other components. The said unit having a horizontal member 7 with a 90 degree offset portion 29 as in FIG. 2. Hollow cavity below said offset portion provides a receptacle for a friction-fastened premanufactured leveler leg as shown in FIG. 3. The said component having two table leg members 13 fused at 10 degree angle relative to horizontal member 7 as in FIG. 2. Table leg members fused to upper horizontal member 17 at similar angle. The table leg and seat leg component 1 connected in series by two connector components 2 as in FIG. 1 in parallel. The joining means for connector components 2 is a bolt and nut assembly 38 as in FIG. 2.

A connector component 2 having an elongated square tubular structure 24 joined perpendicularly to fastening plates 25 as in FIG. 2. A conventional level seat post component 4 as in FIG. 1 attached to top surface of horizontal member 7 of table leg and seat leg component 1. The said seat component having an elongated square tubular structure 15 fused at an angle of ten degrees relative to said fastening plate 10.

A single seat component 11 formed out of solid plastic. The said seat having a trapezoid shape. The said component fastened to fastener plates 10 on conventional seat post component 4 and angled ergo seat post component 5.

A angled ergo seat and knee support frame post component 5 attached to horizontal member 7 of table leg and seat leg component 1 as shown in FIG. 1. The said angular ergo seat knee support component 5 having an elongated tubular seat post member 15 joined at ten degrees relative to bottom fastening plate 10. The said tubular post member 15 joined to angular seat fastening plate 14 at an acute angle of twenty two point five degrees. A knee support frame member 16 extending out from said tubular post member 15 at an upward angle of ten degrees relative to the seat post member 15 as in FIG. 2.

A knee support cushioned pad component 12 formed out of solid plastic and silicon composites, said support component having a rectilinear shape. The said component attached to knee support frame member 16 by means of a mechanical bolt and nut assembly 23.

An end seat table leg and seat leg component 3 attached to existing table leg and seat leg component 1 as in FIG. 1 as an optional seating configuration. The said end seat component 3 having a lower horizontal frame member 39 as in FIG. 2 joined perpendicularly to fastening plate 19. A table leg member 20 fused to tubular structure at a ten degree angle relative to the horizontal member 21. The said horizontal member having a ninety degree offset portion 29. Hollow end of said offset portion provides cavity for receiving premanufactured threaded leveler leg 6. The end seat component having an upper horizontal member 21 joined to table leg at ten degrees relative to member 20. The upper horizontal member joined perpendicularly to fastening plate 18 means for attaching end seat component 3 to table leg and seat leg component 1, a mechanical fastener extended through fastener plates 18,19 and upper horizontal member 17 as in FIG. 7.

Figure 4:
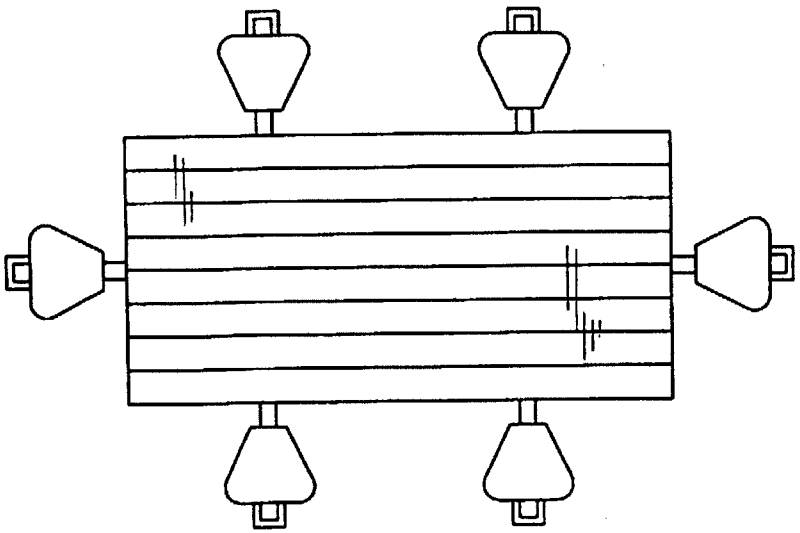
FIG. 4 is a top view of table less angled ergo seat and knee rest frame component.
Figure 5:
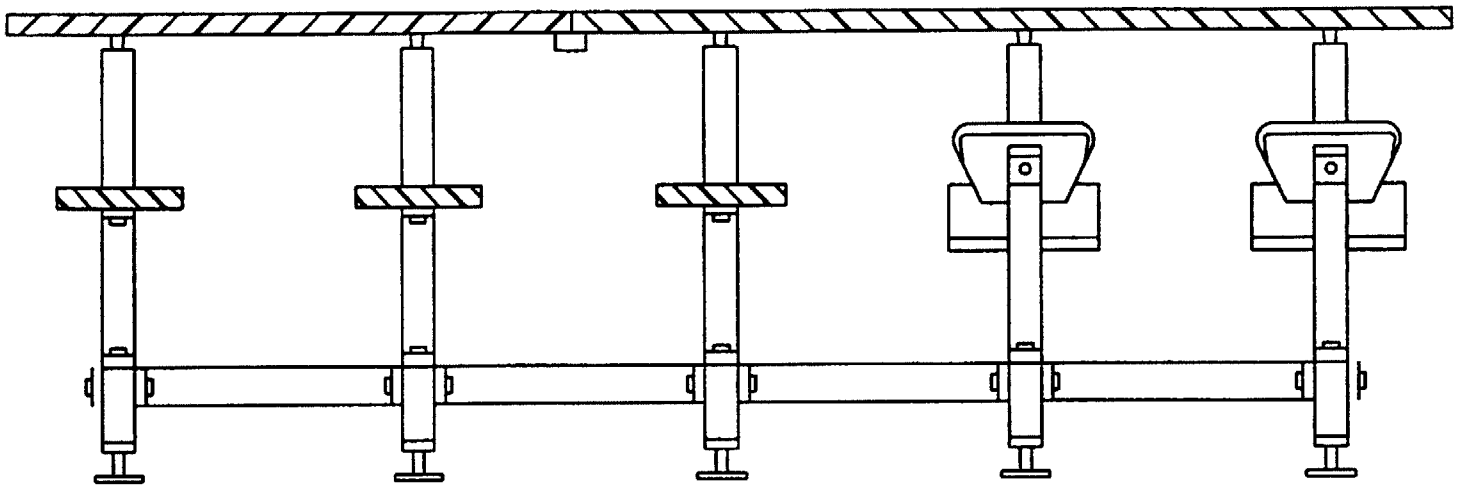
FIG. 5 is an elevation view of table in a continuous configuration, utilizing the four seat and six seat table top options.
Figure 6:
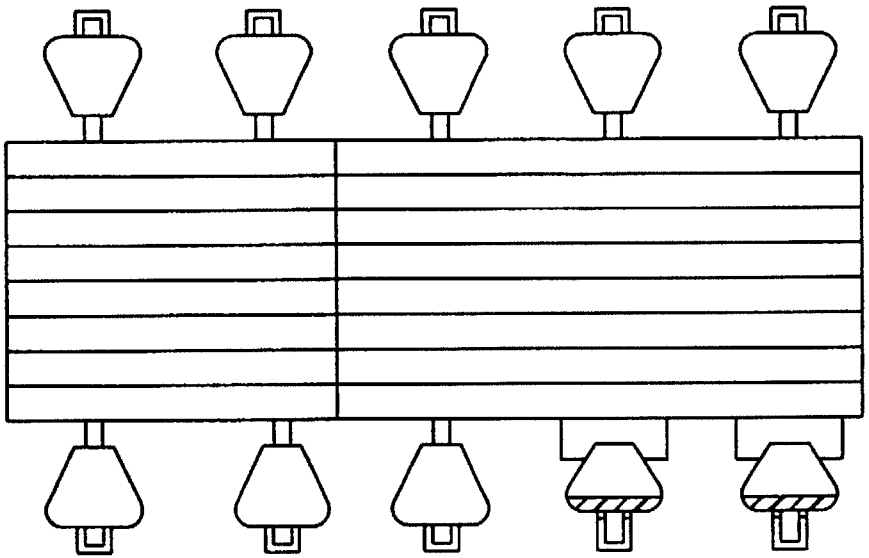
FIG. 6 is a top view of FIG. 5.

A table top surface component 30 as in FIG. 7 having either a solid wood substrate, or in the preferred embodiment of the invention a set of elongated vinyl extrusions 28 rectilinear in shape, and joined on edge by a table top connector member 26. The said table top connector member having a singular elongated extrusion 26 predrilled with fastening holes 33,35 as in FIG. 8. The cross section of said connector member 26 is in the general shape of a modified U with two fastening tabs 32 extending perpendicularly from top portion of U shaped member 26. The said table top surface component 30 attached to table frame 1,3 as in FIG. 1. Means for connection a bolt with locking nut assembly. The said bolt extended through table top connector member holes 33 and horizontal frame member holes 34 to provide a rigid nonrotative connection. The invention herein described will either be used as a table set with four seat and six seat units connected in series maintaining a continuous frame configuration as is shown in FIG. 5,6 or as a four seat and six seat unit in a closed end seat configuration as in FIG. 4.

In use the seats are accessed by straddling the seat post assembly. The modular frame system allows for optional seat arrangements on an existing frame. The modular design allows expandability to any existing frame without sacrificing structural integrity. All components are designed to break down flat into a sizable box for ease of shipping.

In the chosen embodiments of my invention, there are many features and parts that may be varied in form, shape, or contour, and I reserve the rights to make such changes as I may deem necessary, without affecting the function of the device.

I claim:

1. A picnic table with attached interchangeable individual seats on an expandable modular frame, said frame having a plurality of interchanging modular components comprising:

a table leg and seat leg assembly having a plurality of square extruded hollow members fused in a linear arrangement including a horizontal beam, the beam comprising an elongated square extrusion, said beam turned down on opposing ends perpendicular to its longitudinal axis, a hollow end of said turned down end providing means for receiving an adjustable leveler leg component, a plurality of fastener holes placed midway on a vertical surface of said beam, a plurality of fastener holes on a top surface of said beam, said top surface fastener holes being positioned on opposing ends of said beam and corresponding to a spacing of fastener holes on a fastener plate of attached seat post components, two elongated hollow square extrusion members fused to said beam, each at an angle of ten degrees relative to its respective longitudinal axis in an opposing upward configuration, an upper connector member having an elongated hollow extrusion joined to said opposing upward members at upper ends of said members, said upper connector member having a plurality of fastener holes on its top and bottom surfaces, said holes corresponding to a spacing of fastening holes of an attached table top component member, a pair of connector beam components having an elongated hollow square extrusion joined on opposite ends perpendicularly to fastener plates, said fastener plates having fastening holes corresponding to a spacing of said fastener holes on said vertical surface of said horizontal beam, said connector beam component joining plural table leg and seat leg assemblies in parallel, said seat post component having an elongated hollow extrusion fused to said fastener plate and extending at an angle of ten degrees relative to its longitudinal axis, an upper fastening plate fused to said seat post component, said upper fastening plate joined to a level plastic seat in a non-rotational arrangement, an angled ergo seat and knee rest frame post component, said component made up of a plurality of hollow square extruded members fused in a linear arrangement including an elongated post member, said post member fused to a bottom fastener plate with bottom fastener plate holes corresponding to fastener holes of top and bottom surfaces of an attached horizontal beam member of a table end seat frame component, an upper seat post fastener plate, said plate joined to said post member at an acute angle of more than ten degrees, a single seat pad affixed to said upper seat post fastener plate, a knee rest frame member, said member rigidly fused to said elongated post member at an angle of twenty degrees, said knee rest frame member joined to an ergo seat knee support pad member, said table end seat frame component made of a plurality of hollow square extruded members fused and bent into a linear arrangement, said component bent down ninety degrees relative to its longitudinal axis on only one end, said bent down end providing a cavity for receiving a premanufactured leveler leg, a fastening plate joined perpendicularly to the other end, said fastening plate being attached to a vertical surface of said horizontal beam of said table leg and seat leg assembly, a single table leg support member fused to a top surface of said table leg and seat leg component, a fastening plated fused perpendicularly to an end of an upper horizontal beam member of said single table leg support member, said fastening plate being attached to a vertical surface of said upper connector member.

* * * * *